US008117852B2

(12) United States Patent
Mak

(10) Patent No.: US 8,117,852 B2
(45) Date of Patent: Feb. 21, 2012

(54) LNG VAPOR HANDLING CONFIGURATIONS AND METHODS

(75) Inventor: John Mak, Santa Ana, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 589 days.

(21) Appl. No.: 12/281,464

(22) PCT Filed: Apr. 13, 2007

(86) PCT No.: PCT/US2007/009056

§ 371 (c)(1),
(2), (4) Date: Jan. 20, 2009

(87) PCT Pub. No.: WO2007/120782

PCT Pub. Date: Oct. 25, 2007

(65) Prior Publication Data

US 2009/0217676 A1 Sep. 3, 2009

Related U.S. Application Data

(60) Provisional application No. 60/792,196, filed on Apr. 13, 2006.

(51) Int. Cl.

| | |
|---|---|
| ***F17C 3/08*** | (2006.01) |
| *F17C 7/02* | (2006.01) |
| *F17C 13/08* | (2006.01) |
| *B63B 25/26* | (2006.01) |
| *F25J 1/00* | (2006.01) |

(52) U.S. Cl. ..... 62/48.1; 62/45.1; 62/50.1; 62/53.2; 62/240; 62/613

(58) Field of Classification Search ..... 62/45.1, 62/48.1, 50.1, 53.2, 240, 611, 613
See application file for complete search history.

(56) References Cited

U.S. PATENT DOCUMENTS

| | | | | |
|---|---|---|---|---|
| 3,242,681 | A * | 3/1966 | Shaievitz | 62/614 |
| 3,730,201 | A * | 5/1973 | Lefever | 406/197 |
| 3,754,405 | A * | 8/1973 | Rosen | 62/619 |
| 3,857,245 | A * | 12/1974 | Jones | 60/651 |
| 4,315,407 | A * | 2/1982 | Creed et al. | 62/50.2 |
| 6,460,350 | B2 | 10/2002 | Johnson et al. | |
| 6,516,824 | B2 * | 2/2003 | Yoshida et al. | 137/2 |
| 6,526,777 | B1 * | 3/2003 | Campbell et al. | 62/621 |
| 6,640,556 | B2 | 11/2003 | Ursan et al. | |
| 6,658,892 | B2 * | 12/2003 | Fanning et al. | 62/613 |
| 6,745,576 | B1 | 6/2004 | Granger | |
| 7,165,423 | B2 * | 1/2007 | Winningham | 62/620 |
| 2003/0158458 | A1 * | 8/2003 | Prim | 585/800 |
| 2007/0029008 | A1 | 2/2007 | Liu | |

* cited by examiner

*Primary Examiner* — Judy Swann
*Assistant Examiner* — Indrajit Ghosh
(74) *Attorney, Agent, or Firm* — Fish & Richardson, PC

(57) ABSTRACT

LNG from a carrier is unloaded to an LNG storage tank in configurations and methods in which expansion of compressed and condensed boil-off vapors from the LNG storage tank provide refrigeration to subcool the LNG that is being unloaded. Most advantageously, such configuration and methods reduce the amount of boil-off vapors and eliminate the need for a vapor return line and associated compressor.

15 Claims, 2 Drawing Sheets

Prior Art Figure 1

LNG VAPOR HANDLING CONFIGURATIONS AND METHODS

This application claims priority to our copending U.S. provisional patent application with the Ser. No. 60/792,196, which was filed Apr. 13, 2006.

FIELD OF THE INVENTION

The field of the invention is LNG vapor handling, and especially as it relates to vapor handling during LNG storage, ship unloading, and transfer operation.

BACKGROUND OF THE INVENTION

Despite its apparent simplicity, LNG ship unloading poses various significant challenges in several economic and technical aspects. For example, when LNG is unloaded from an LNG ship to a storage tank, LNG vapors are generated in the storage tank due to, among other factors, volumetric displacement, heat gain during LNG transfer and pumping, boil-off in the storage tank, and flashing (due to the pressure differential between the ship and the storage tank). In most cases, these vapors need to be recovered to avoid flaring and pressure buildup in the storage tank system.

Moreover, LNG unloading docks and LNG storage tanks are often separated by relatively large distances (e.g., as much as 3 to 5 miles), which frequently causes significant problems to maintain LNG in the transfer line at cryogenic temperatures (i.e., −255° F. and lower). Worse yet, additional heat is introduced into the LNG by the transfer pumps as the ship unloading pumping horsepower is relatively high to overcome pressure losses due to the long distance between the ship and the storage tanks. As a consequence, large amounts of LNG vapor are formed that must be further processed.

Furthermore, the LNG storage and unloading system must also be maintained at a stable pressure. To that end, a portion of the vapor coming from the storage tank is typically compressed by a vapor return compressor and returned to the ship to make up for the displaced volume. In such configurations, a dedicated vapor return line is required which adds significant cost to the LNG receiving terminal. The excess vapor from the storage tanks is compressed to a sufficiently high pressure by a boil-off gas compressor for condensation in a vapor condenser that utilizes the refrigeration content from the LNG sendout from the storage tank. As relatively large volumes of vapor are handled by such compressors, currently known compression and vapor absorption systems require significant energy and operator attention, particularly during transition from normal holding operation to ship unloading operation. During normal holding operation, the LNG transfer line generally remains stagnant, which leads to an increase in temperature and thermal stress on the transfer line. Alternatively, vapor control can be implemented using a reciprocating pump in which the flow rate and vapor pressure control the proportion of cryogenic liquid and vapor supplied to the pump as described in U.S. Pat. No. 6,640,556 to Ursan et al. However, such configurations are often impractical and fail to eliminate the need for vapor recompression in LNG receiving terminals.

Alternatively, or additionally, a turboexpander-driven compressor may be employed as described in U.S. Pat. No. 6,460,350 to Johnson et al. Here the energy requirement for vapor recompression is typically provided by expansion of a compressed gas from another source. However, where compressed gas is not available from another process, such configurations are typically not implemented. In still other known systems, methane product vapor is compressed and condensed against an incoming LNG stream as described in published U.S. Pat. App. No. 2003/0158458. While such systems increase the energy efficiency as compared to other systems, various disadvantages nevertheless remain. For example, vapor handling in such systems requires costly vapor compression and is typically limited to plants in which production of a methane rich stream is desired.

In yet another system, as described in U.S. Pat. No. 6,745,576, mixers, collectors, pumps, and compressors are used for re-liquefying boil-off gas in an LNG stream. In this system, the atmospheric boil-off vapor is compressed to a higher pressure using a vapor compressor such that the boil-off vapor can be condensed. While such a system typically provides improvements on control and mixing devices in a vapor condensation system, it nevertheless inherits most of the disadvantages of known configurations as shown in Prior Art FIG. 1.

Thus, most of the currently known processes and configurations for LNG ship unloading and regasification require vapor compression and absorption that are typically energy inefficient. Therefore, there is still a need for improved configurations and methods for vapor handling in LNG unloading and regasification terminals.

SUMMARY OF THE INVENTION

The present invention is directed to configurations and methods of LNG transfer from an LNG source to an LNG storage tank, where refrigeration content of compressed, condensed, and expanded boil-off from the LNG storage tank is employed to subcool the LNG stream in a position intermediate the LNG source and the LNG storage tank. Such configurations and methods advantageously reduce boil-off volume in the storage tank, and further eliminate the need for a vapor return line and compressor between the LNG source and the LNG storage tank, especially where the LNG source is an LNG carrier.

In one aspect of the inventive subject matter, a system for transfer of LNG from an LNG carrier to an LNG storage tank comprises an exchanger (preferably located at the unloading dock) that is configured to subcool the unloaded LNG using refrigeration content of a portion of the LNG from the LNG storage tank. In such configurations, it is typically preferred that a separator is configured to receive and separate depressurized heated LNG into a vapor phase and a liquid phase. A return line may then be configured to feed the vapor phase to the LNG carrier, and a pump may be configured to pump the liquid phase to the LNG storage tank. Typically, a compressor is configured to receive boil-off from the LNG storage tank.

In further contemplated aspects, a bypass provides at least a portion of the sendout LNG liquid to mix with the compressed boil-off from the LNG storage tank, and a condenser or absorber is configured as a contacting device for the compressed boil-off vapor and is still further configured to receive sendout LNG from the LNG storage tank to thereby form the condensed boil-off from the LNG storage tank.

In another aspect of the inventive subject matter, an LNG unloading plant includes an LNG source that is configured to provide an LNG stream and that is fluidly coupled to an LNG storage tank configured to provide a liquid LNG and an LNG vapor. A compressor and a condenser/absorber are fluidly coupled to the LNG storage tank and configured to receive the LNG boil-off vapor and to produce a pressurized send-out LNG. Contemplated plants further include a pressure reduction device that reduces pressure of the pressurized LNG sendout liquid and a heat exchanger that subcools the unloaded LNG stream using the depressurized LNG sendout liquid from the condenser or absorber.

Most typically, the pressure reduction device is configured to cool via reduction of pressure the saturated LNG liquid to a temperature that is lower than the temperature of the LNG source (e.g., at least 1 to 3° F.). A separator downstream of the heat exchanger receives the depressurized heated saturated LNG liquid and provides a vapor and a liquid, wherein most preferably a vapor return line delivers the vapor from the separator to the LNG source, and wherein a pump pumps the depressurized liquid to the LNG storage tank.

Consequently a method of transferring an LNG stream from an LNG source (e.g., an LNG carrier) includes a step of forming a pressurized saturated LNG liquid from a vapor of an LNG storage tank, and another step of cooling the unloaded LNG stream (e.g., 1° F. or lower) using a heat exchanger that receives refrigeration content from the depressurized sendout LNG liquid. Most typically, the depressurized sendout LNG liquid is heated in the heat exchanger and separated into a vapor portion and a liquid portion, wherein the liquid portion is fed to the LNG storage tank, and/or wherein the vapor portion is fed to the LNG source. In such methods, the LNG storage tank provides a boil-off that is compressed, and the compressed boil-off is preferably mixed with sendout liquid LNG, and wherein the mixture is condensed in a condenser or absorber to thereby form the pressurized saturated LNG liquid.

Various objects, features, aspects and advantages of the present invention will become more apparent from the following detailed description of preferred embodiments of the invention.

BRIEF DESCRIPTION OF THE DRAWINGS

Prior Art

DETAILED DESCRIPTION

The present invention is directed to various configurations and methods for an LNG receiving terminal in which sendout LNG liquid from a storage tank is employed as refrigerant to subcool LNG that is being unloaded. Using such configurations, it should be noted that vapor generation from the tank is reduced to a significant degree and that the vapor return compressor and the return line to the LNG carriers of heretofore known configurations can be eliminated. It should still further be appreciated that the circulation line and pump system for the sendout LNG liquid can be advantageously used during normal holding operation, which will maintain the LNG transfer line at cryogenic temperature.

Most preferably, LNG is provided from an LNG carrier vessel or other remote source using conventional LNG transfer lines and one or more pumps to a conventional LNG storage tank that is fluidly coupled to a boil-off compressor and vapor condenser or absorber. The vapor condenser or absorber produces saturated liquid at high pressure, providing at least a portion preferably to an LNG unloading dock. There, the saturated LNG liquid is let down in pressure, heat exchanged with the unloaded LNG from the carrier vessel or other remote source to thereby chill the unloaded LNG. Vapor evolved from the saturated LNG liquid after passing through the heat exchanger is advantageously returned to the ship to maintain the pressure in the transport vessel, while the flashed liquid is pumped to the LNG transfer line to the storage tank. Thus, it should be recognized that the unloaded LNG is subcooled, which eliminates or at least substantially reduces vapor flashing to the storage tank. Consequently, vapor evolution from the storage tank is reduced, which in turn reduces the duty on the vapor recompression and condenser system. Moreover, due to the reduced vapor generation from the storage tank, the vapor return compressor system and the relatively long vapor return line common to most known configurations can be eliminated.

Figure 1:
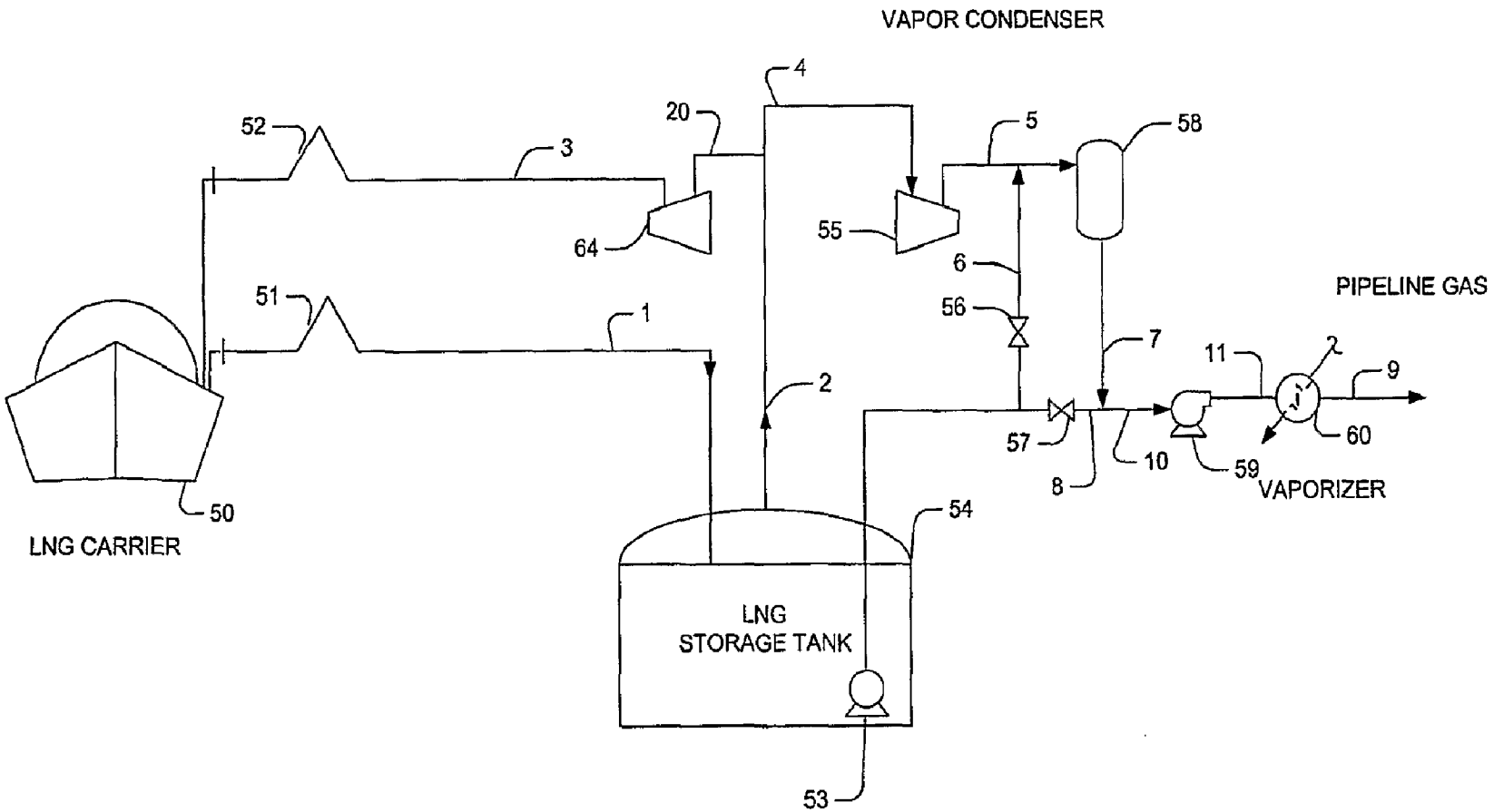
FIG. 1 is an exemplary schematic of a known LNG unloading station.

To illustrate the advantages over previously known configurations and methods, a typical prior art LNG unloading terminal is shown in Prior Art FIG. 1. Here, LNG at about −255° F. to −260° F. is unloaded from an LNG carrier ship 50 via unloading arm 51 and transfer line 1 into storage tank 54, typically at a flow rate of 40,000 GPM to 60,000 GPM. The unloading operation typically lasts for about 12 to 16 hours, and during this period an averaged rate of 40 MMscfd of vapor is generated from the storage tank as a result from the heat gain during the transfer operation (e.g., by the ship pumps, heat gain from the surroundings), the displacement vapor from the storage tanks, and the liquid flashing due to the pressure differential between the carrier and the storage tank. The LNG carrier ship typically operates at a pressure slightly less than that of the storage tank (e.g., LNG ship at 16.2 psia to 16.7 psia, storage tank at 16.5 psia to 17.2 psia). The vapor stream 2 from the storage tank is split into two portions, stream 20 and stream 4. Stream 20, typically at an average flow rate of 20 MMscfd, is returned to the LNG ship via a vapor return compressor 64 that discharges to vapor line 3 to the LNG ship via vapor return arm 52 for replenishing the displaced volume from the unloading process. The power consumption by compressor 64 is typically 500 HP to 1,500 HP, predominantly depending on the tank boil off flow rate and compressor discharge pressure, which in turn depends on the vapor return line size and distance between the storage tank 54 and the LNG carrier 50. It should be appreciated that the vapor return compressor and the vapor return line substantially contribute to the capital and operating cost of such ship unloading systems.

Stream 4, typically at an average flow rate of 20 MMscfd, is compressed by compressor 55 to about 80 psig to 115 psig and fed as stream 5 to the vapor absorber 58. Here vapor is de-superheated, condensed, and absorbed by a portion of the sendout LNG which is delivered via valve 56 and stream 6. The power consumption by compressor 55 is typically 1,000 HP to 3,000 HP, depending on the vapor flow rate and compressor discharge pressure. LNG from the storage tank 54 is pumped by the in-tank primary pumps 53 to about 115 to 150 psia at a typical sendout rate of 250 MMscfd to 1,200 MMscfd. Stream 6, a subcooled liquid at −255° F. to −260° F., is routed to the absorber 58 to mix with the compressor discharge stream 5 using a heat transfer contacting device such as trays and packing. The operating pressures of the vapor absorber and the compressor are determined by the LNG sendout flow rate. A higher LNG sendout rate with higher refrigeration content would lower the absorber pressure, and hence require a smaller compressor. However, the absorber design is also designed to operate under the normal holding operation when the vapor rate is lower, and the liquid rate may be reduced to a minimal.

The flow rate of stream 6 and the bypass stream 8 are controlled using the respective control valves 56 and 57 as needed for controlling the vapor condensation process. The vapor condenser produces a bottom saturated liquid stream 7 typically at about −200° F. to −220° F., which is then mixed with stream 8 forming streaming 10. Stream 10 is pumped by high pressure pump 59 to typically 1000 psig to 1500 psig forming stream 11, which is heated in LNG vaporizers 60 forming stream 9 at about 40° F. to 60° F. to meet pipeline specifications. The LNG vaporizers are typically open rack type exchangers using seawater, fuel-fired vaporizers, or vaporizers using a heat transfer fluid.

Therefore, it should be appreciated that prior art configurations and methods require substantial energy for compression of the vapors coming off the storage tank for both vapor condensation and return to the LNG source (typically LNG carrier). Moreover, and especially in relatively long distance between the carrier and the tank, the handling of vapor evolution from the tank is very costly.

In contrast, contemplated configurations and methods alleviate the above problems by subcooling the LNG flow between the LNG carrier and the LNG storage tank using refrigeration content of expanded sendout LNG liquid and/or compressed storage tank vapor condensate. Thus, preferred configurations include an LNG source that is configured to provide an LNG stream and that is fluidly coupled to an LNG storage tank that is configured to provide a liquid LNG and an LNG vapor. A compressor and a condenser or absorber are fluidly coupled to the LNG storage tank and configured to receive the LNG vapor and to thus provide a pressurized saturated LNG liquid. A pressure reduction device (e.g., JT valve, expansion turbine, etc.) is configured to reduce pressure of at least a portion of the pressurized sendout LNG liquid, and a heat exchanger employs the refrigeration content of the expanded sendout LNG to subcool the unloaded LNG stream to a temperature that is lower than the temperature of the LNG source.

Most preferably, a separator is fluidly coupled to and located downstream of the heat exchanger and configured to receive the depressurized heated saturated LNG liquid. The separator provides a vapor and a liquid, wherein a return arm is configured to deliver the vapor to the LNG source. The depressurized liquid is fed to the LNG storage tank using a pump.

Figure 2:
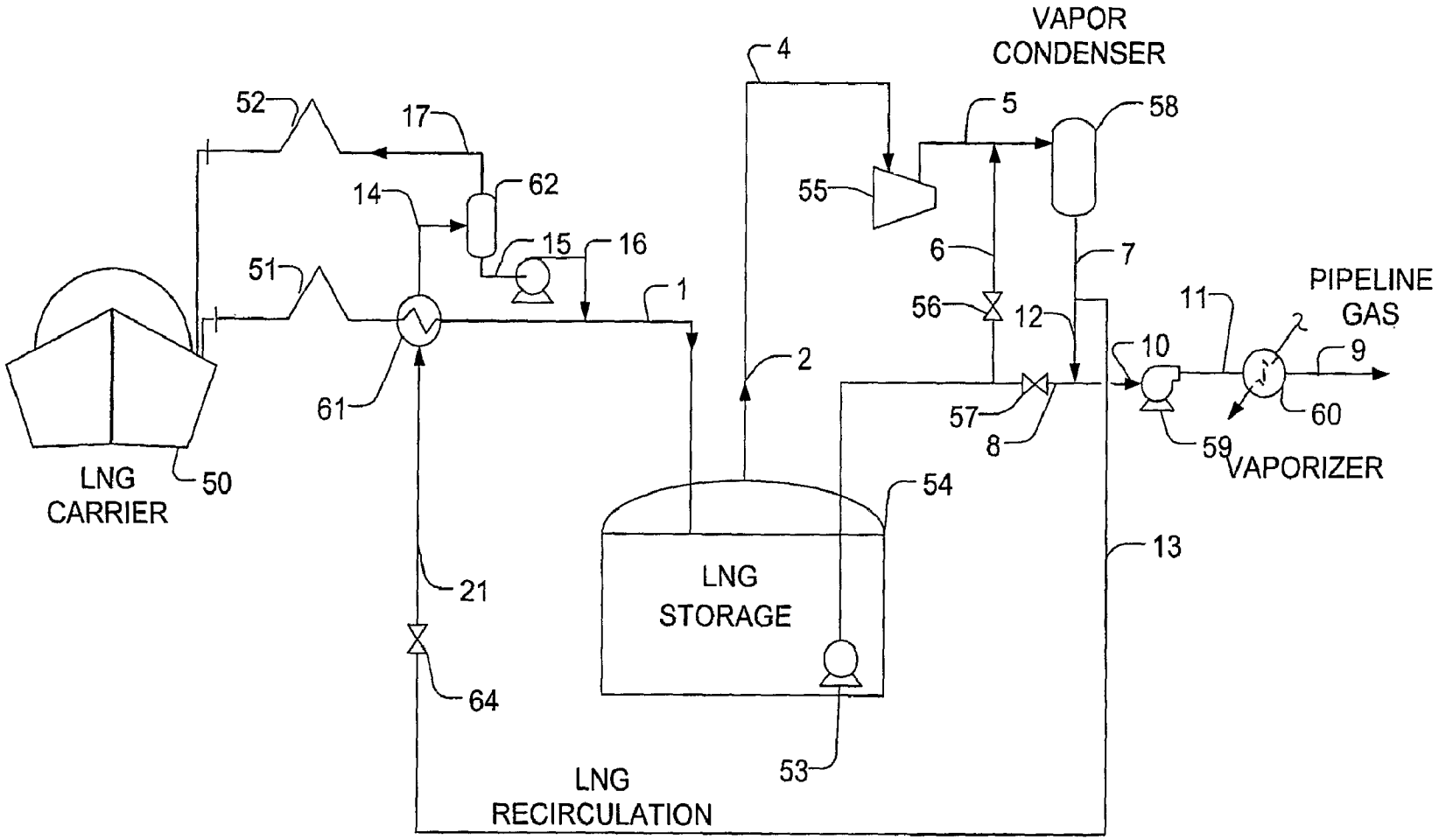
FIG. 2 is an exemplary schematic of an LNG unloading station according to the inventive subject matter.

One exemplary configuration according to the inventive subject matter is depicted in FIG. 2 in which an LNG ship unloading system is coupled to an LNG circulation system. In such circulation system, a portion of the sendout LNG and the saturated liquid from the vapor condenser is provided to the LNG docking area, letdown in pressure to thereby chill the unloaded LNG. Flashed vapor is used to supply vapor to the ship, which eliminates the need for a vapor return compressor and the long vapor return line. Flashed liquid is returned to the storage tank. Among other advantages, it should be recognized that contemplated configurations and methods reduce vapor loads on the vapor recompression and condensation system, and also substantially decrease the capital and energy requirements.

Here, LNG from ship 50 is unloaded via liquid unloading arm 51 and is cooled in a heat exchanger 61 using a portion of the saturated liquid (stream 13) from the bottom of the vapor condenser 58 or sendout LNG stream 8 via a bypass (e.g., when valve 56 is closed; not shown in FIG. 2). Stream 13, at a pressure between about 80 psig to 115 psig and at a temperature of about −220° F. to −250° F., is provided at a rate of about 600 to 1200 gpm via a circulation line to the LNG ship unloading area. Stream 13 is letdown in pressure to about 1 to 2 psig in a letdown valve 64 forming a chilled stream 21 at −257° F. to −259° F. This chilled liquid is then used to cool the unloaded LNG from LNG unloading arm 51, from −254° F. to about −255° F. It should be appreciated that even a slight reduction in the unloaded LNG temperature (typically 1° to 2° F. or lower) will significantly reduce the vapor load when LNG is unloaded to the storage tank 54, mainly due to the large unloading flow rate of 40,000 gpm to 60,000 gpm. The two phase stream 14 leaving the heat exchanger 61 is separated in separator 62. The separated vapor stream 17 is returned to the LNG ship via the vapor return arm 52 to maintain the ship pressure. The flashed liquid 15 is pumped by a pump forming stream 16, which is preferably combined with the unloaded LNG in LNG transfer line 1 and returned to the storage tank 54. It should be appreciated that using such circulation, the vapor return compressor 64 and vapor return line 3 of the plant of Prior Art FIG. 1 are no longer needed. Additionally, as heat exchanger 61 subcools the unloaded LNG, vapor generation from the LNG in storage tank 54 is reduced, which in turn reduces the vapor loads on the boil-off gas compressor 55 to a significant degree.

The vapor stream 2 from storage tank 54, typically at a flow rate of 10 to 20 MMscfd is routed to the compressor 55 as stream 4 and compressed to about 80 psig to 115 psig and fed as stream 5 to the vapor absorber 58. As in known configurations, the compressed vapor is de-superheated, condensed, and absorbed by a portion of the sendout LNG which is delivered via valve 56 and stream 6. The flow rate of stream 6 and the bypass stream 8 are controlled using the respective control valves 56 and 57 as appropriate for controlling the vapor condensation process. The vapor condenser produces a bottom saturated liquid stream 7 typically at about −200° F. to −250° F. One portion of stream 7, stream 12, is then mixed with stream 8 forming stream 10. Stream 10 is pumped by high pressure pump 59 to typically 1000 psig to 1500 psig forming stream 11, which is heated in LNG vaporizers 60 forming stream 9 at about 40° F. to 60° F. to meet pipeline specifications. The LNG vaporizers are typically open rack type exchangers using seawater, fuel-fired vaporizers, or vaporizers using a heat transfer fluid. The other portion of stream 7, stream 13, is the fed to the pressure reduction device 64 as described above. Further configurations, methods, and contemplations are presented in our copending International patent application with the publication number WO 2005/045337, which is incorporated by reference herein.

Therefore, a system for transfer of LNG from an LNG carrier to an LNG storage tank will comprise an exchanger that is configured to receive and subcool unloaded LNG from the carrier using refrigeration content of sendout LNG and condensed and expanded boil-off from the LNG storage tank. Most preferably, contemplated configurations also include a separator that receives and separates the two-phase LNG downstream of the exchanger into a vapor phase and a liquid phase. The vapor from the separator may then be routed via a return arm to the LNG carrier. However, in alternative embodiments, the vapor may also be condensed or used as refrigerant in other processes. The liquid from the separator is preferably pumped to the LNG storage tank as a separate stream, or as a combined stream with the LNG that is being unloaded from the carrier. Alternatively, the liquid may also be stored separately or otherwise utilized (e.g., as refrigerant in a thermally coupled process). Similar to known configurations, contemplated unloading terminals will preferably include a compressor receives and compresses the boil-off from the LNG storage tank. Typically, the pressure is selected such that the vapor can be condensed in an absorber or other contact device via combination with an LNG stream, for example, from the carrier, but more preferably from a position downstream of the LNG storage tank). Therefore, in preferred configurations, a bypass is configured to provide LNG liquid to the compressed boil-off from the LNG storage tank for condensation of the boil-off vapor. In such configurations, it is preferred to include a condenser or absorber that receives the compressed boil-off from the LNG storage tank and that further receives liquid from the LNG storage tank to thereby form condensed boil-off from the LNG storage tank. Such combination of compressed vapors and LNG may be done upstream of or within the condenser or absorber.

Consequently, it should be appreciated that a method of transferring an LNG stream from an LNG source includes a step of forming a pressurized saturated LNG liquid from a vapor of an LNG storage tank, and a further step of cooling the LNG stream using a heat exchanger that receives refrigeration content from the depressurized sendout LNG liquid. Most preferably, the depressurized sendout LNG liquid is heated in the heat exchanger against the LNG that is being unloaded, and separated into a vapor portion and a liquid portion. The liquid portion is preferably fed to the LNG storage tank, while the vapor portion is preferably fed to the LNG source (e.g., LNG carrier). It should be noted that in such methods the liquid stream from the LNG source is subcooled at least 1° F., and more typically between 1.1° F. and 5.0° F.

The LNG storage tank provides a boil-off that is compressed using a conventional compressor (which may be energetically coupled with an expander where appropriate) and the compressed boil-off vapor is then mixed with sendout LNG upstream of or within an absorber, condenser, or other contact device. Thus, it should be appreciated that a pressurized sendout LNG liquid is formed, wherein one portion is combined with LNG leaving the storage tank, while another portion is used as refrigerant after expansion (which may be a JT valve or expansion turbine).

Thus, specific embodiments and applications of LNG vapor handling configurations and methods have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. An unloading plant for transfer of LNG from an LNG carrier to an LNG storage tank comprising:

a compressor configured to receive and compress boil-off from the LNG storage tank;

a condenser or absorber configured to receive compressed boil-off from the compressor and a sendout LNG stream from the LNG storage tank to thereby produce a saturated liquid stream that is composed of the sendout LNG stream and compressed boil-off condensed therein;

a pressure reduction device configured to reduce pressure of a portion of the saturated liquid stream; and an exchanger that is configured to subcool the LNG coming from the LNG carrier using refrigeration content of the portion after the pressure of the portion has been reduced.

2. The unloading plant of claim 1 further comprising a separator fluidly coupled to and downstream of the exchanger and configured to separate a vapor phase and a liquid phase from the portion.

3. The unloading plant of claim 2 further comprising a return line that is configured to feed the vapor phase to the LNG carrier.

4. The unloading plant of claim 2 further comprising a pump that is configured to pump the liquid phase to the LNG storage tank.

5. A plant comprising:

an LNG source configured to provide an LNG stream to an LNG storage tank that is configured to provide a sendout LNG and an LNG vapor;

a compressor configured to compress the LNG vapor;

a condenser or absorber fluidly coupled to the LNG storage tank and configured to receive the compressed LNG vapor and to provide a pressurized saturated liquid stream that is composed of the sendout LNG and LNG vapor condensed therein;

a pressure reduction device configured to reduce pressure of a portion of the pressurized saturated liquid stream; and a heat exchanger that is configured to subcool the LNG stream using the portion of the depressurized saturated liquid stream from the pressure reduction device.

6. The plant of claim 5 wherein the pressure reduction device is configured to cool by reduction of pressure of the pressurized saturated liquid stream to a temperature that is lower than the temperature of the unloaded LNG source.

7. The plant of claim 5 further comprising a separator that is located downstream of the heat exchanger and that is configured to receive the depressurized heated saturated liquid stream and to provide a vapor and liquid.

8. The plant of claim 7 further comprising a return arm that is configured to deliver the vapor from the separator to the LNG source, and further comprising a pump that is configured to pump the liquid to the LNG storage tank.

9. A method of transferring an LNG stream from an LNG source comprising:

compressing boil-off from an LNG storage tank;

receiving the compressed boil-off and a sendout LNG stream from the LNG storage tank in a condenser or absorber to form a pressurized saturated liquid stream that is composed of the sendout LNG stream and boil-off condensed therein;

depressurizing a portion of the pressurized saturated liquid stream; and cooling the LNG stream using a heat exchanger which receives refrigeration content from the portion of the depressurized saturated liquid stream.

10. The method of claim 9 wherein the depressurized LNG saturated liquid stream is heated in the heat exchanger and then separated into a vapor portion and a liquid portion.

11. The method of claim 10 wherein the liquid portion is fed to the LNG storage tank.

12. The method of claim 10 wherein the vapor portion is fed to the LNG source.

13. The method of claim 9 wherein the LNG stream is subcooled at least 1° F.

14. The method of claim 9 wherein another portion of the pressurized saturated liquid stream is combined with sendout LNG upstream of a vaporizer.

15. The method of claim 9 wherein the LNG source is an LNG carrier.

* * * * *